US006431152B1

(12) United States Patent
Estacio

(10) Patent No.: US 6,431,152 B1
(45) Date of Patent: Aug. 13, 2002

(54) INJECTOR HOLD DOWN CLAMP

(75) Inventor: Edgardo Y Estacio, Itasca, IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/823,691

(22) Filed: Mar. 30, 2001

(51) Int. Cl.[7] ..... F02M 55/02
(52) U.S. Cl. ..... 123/470
(58) Field of Search ..... 123/468, 469, 123/470, 90.39, 90.41, 195 A

(56) References Cited

U.S. PATENT DOCUMENTS

| | | | | |
|---|---|---|---|---|
| 4,206,725 A | | 6/1980 | Jenkel et al. | |
| 4,246,877 A | | 1/1981 | Kennedy | |
| 5,499,612 A | | 3/1996 | Haughney et al. | |
| 5,503,128 A | * | 4/1996 | Hickey et al. | 123/470 |
| 5,566,658 A | | 10/1996 | Edwards et al. | |
| 5,765,534 A | * | 6/1998 | Brown et al. | 123/470 |
| 5,794,595 A | | 8/1998 | Berger et al. | |
| 5,803,034 A | | 9/1998 | Gruber et al. | |
| 5,806,494 A | | 9/1998 | Glassey | |
| 5,899,190 A | * | 5/1999 | Nakagomi et al. | 123/470 |
| 6,116,218 A | * | 9/2000 | Sato et al. | 123/470 |
| 6,170,467 B1 | * | 1/2001 | Girard | 123/470 |
| 6,196,194 B1 | | 3/2001 | Mitchell | |
| 6,269,798 B1 | * | 8/2001 | Takahashi et al. | 123/469 |

* cited by examiner

*Primary Examiner*—Andrew M. Dolinar
*Assistant Examiner*—Hai Huynh
(74) *Attorney, Agent, or Firm*—Dennis Kelly Sullivan; Jeffrey P. Calfa; Neil T. Powell

(57) ABSTRACT

The present invention provides a compact injector hold down clamp assembly that allows for disassembly of the fuel injector from a cylinder head without prying the fuel injector from the cylinder head. The injector hold down clamp assembly comprises a clamp having a fastener channel and a retainer ring bore, a fastener with a retainer ring section that is operatively inserted in the fastener channel, and a retaining ring that is operatively attached to the fastener retainer ring section. The retaining ring acts on the retainer ring bore during disassembly and thereby allows the fuel injector and injector hold down clamp assembly to be removed simultaneously. The retaining ring is a partial ring that extends about 230 degrees. The injector clamp further comprises a rear clamp seat, and a first and second a clamp arm that engage the fuel injector.

13 Claims, 6 Drawing Sheets

FIG. 4
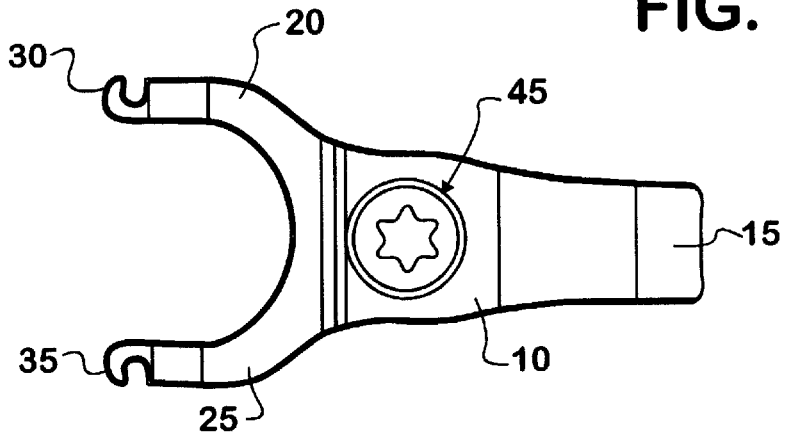
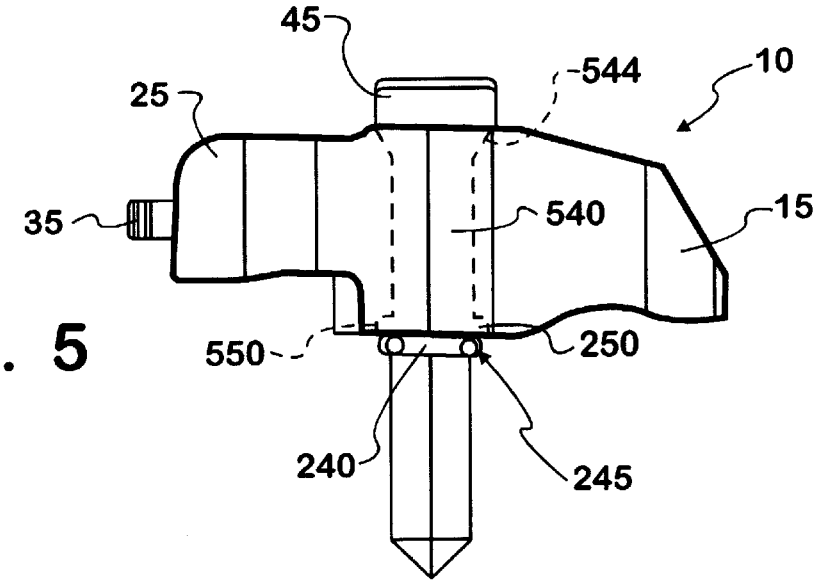
FIG. 5
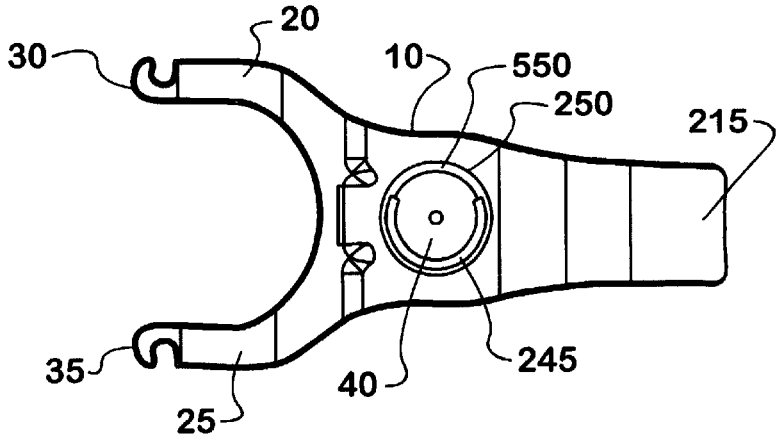
FIG. 6

40

INJECTOR HOLD DOWN CLAMP

FIELD OF THE INVENTION

This invention relates generally to fuel injector assembly on cylinder heads in internal combustion engines. More particularly, this invention relates to injector clamps that securely fasten fuel injectors to the cylinder head in a diesel engine.

BACKGROUND OF THE INVENTION

The assembly of fuel injectors onto a cylinder head and the use of certain types of injector hold down clamps to set the injector into the cylinder head is well known. Existing devices used to hold down or secure a fuel injectors to cylinder heads are many times impractical since they tend to be bulky and thereby add to the crowding of components on the limited space on a cylinder head. Also, during disassembly or removal of the fuel injector from the cylinder head, the use of prior art clamps typically requires that the fuel injector be pried from its position in the cylinder head with some prying tool. Prying the fuel injector from the cylinder head many times results in a damaged injector. Further, since the space around the fuel injector in the cylinder head is very limited greater difficulty is encountered in prying out, e.g., via some sort of lever, the fuel injector from the cylinder head.

Accordingly, there is a need for an injector hold down clamp that will allow for removal or disassembly of the fuel injector from the cylinder head without the need to pry the fuel injector from the cylinder head.

SUMMARY OF THE INVENTION

The present invention provides a compact injector hold down clamp assembly that allows for the disassembly of the fuel injector from a cylinder head without the need pry the fuel injector from the cylinder head during disassembly. The hold down clamp assembly also allows for easy assembly of the fuel injector to the cylinder head in the limited space on the cylinder head.

The injector hold down clamp assembly of the present invention is used with a cylinder head in an internal combustion engine and comprises a clamp having a fastener channel and a retainer ring bore, a fastener that is operatively inserted in the fastener channel and has a fastener ring section, and a retaining ring that is operatively attached to the fastener retainer ring section. In this manner the retaining ring acts on the retainer ring bore during disassembly and thereby allows the fuel injector and injector hold down clamp assembly to be removed simultaneously as a unit. The retaining ring is preferably a partial ring or toroid that extends about 230 degrees. The injector clamp further comprises rear clamp seat and a first and second a clamp arm that will engage the fuel injector. The first and second clamp arms each further have a clamp hook that together cooperatively engage an injector retaining wire.

The following drawings and description set forth additional advantages and benefits of the invention. More advantages and benefits are obvious from the description and may be learned by practice of the invention.

BRIEF DESCRIPTION OF THE DRAWINGS

The present invention may be better understood when read in connection with the accompanying drawings, of which:

FIG. 4 shows a top view of the injector hold down clamp assembly shown in FIGS. 1–3;

FIG. 5 shows a side view of the injector hold down clamp assembly shown in FIGS. 1–3;

FIG. 6 shows a bottom view of the injector hold down clamp assembly shown in FIGS. 1–3;

DESCRIPTION OF THE INVENTION

Figure 1:
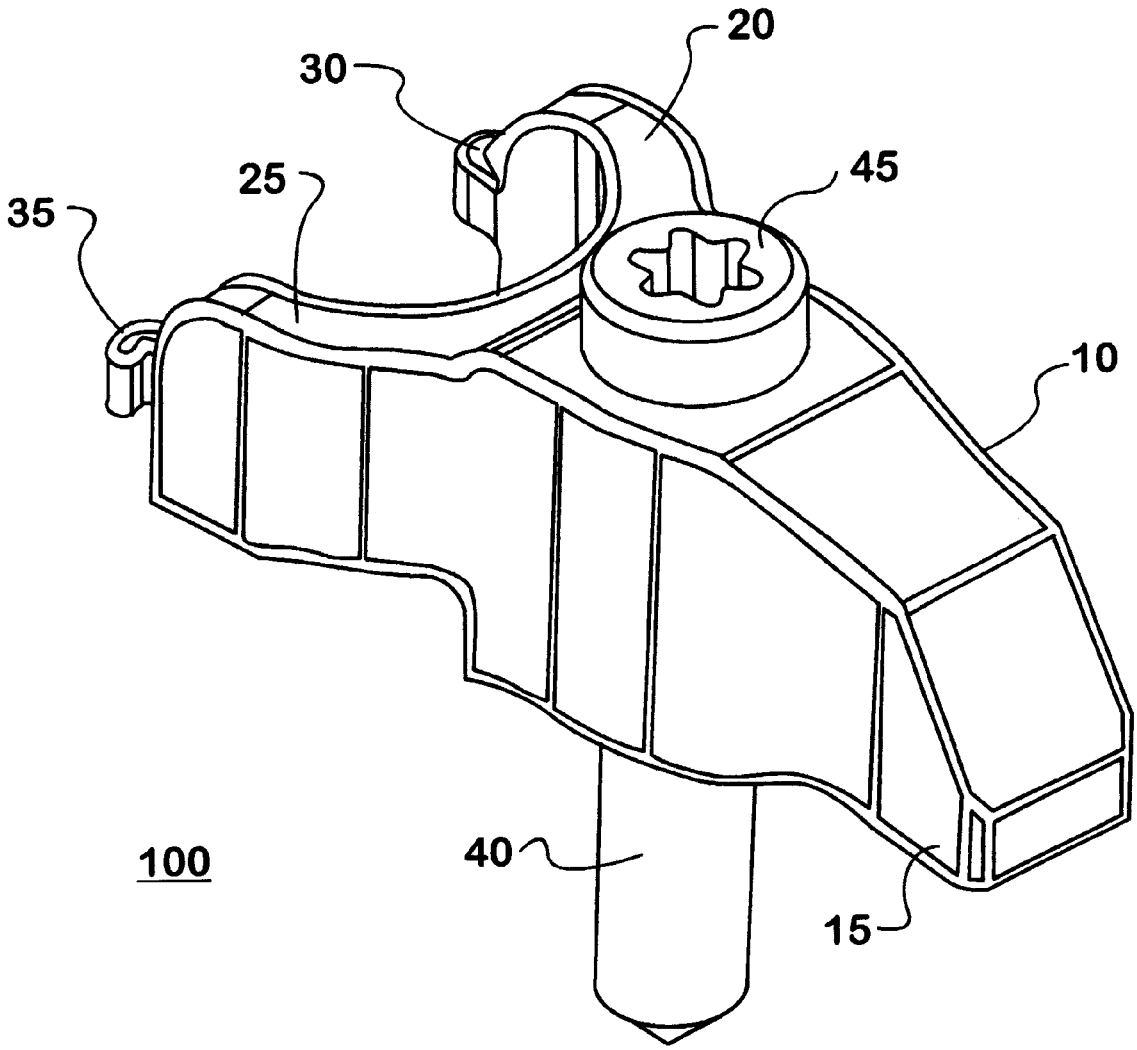
FIG. 1 shows a perspective view of an embodiment of an injector hold down clamp assembly according to the present invention.

FIG. 1 illustrates a perspective view of an embodiment of an injector hold down clamp assembly 100 according to the present invention. The injector hold down clamp assembly 100 is preferably adapted to cooperatively engage a fuel injector 200 (shown in FIG. 2) for mounting on a cylinder head 300 (shown in FIG. 3) in an internal combustion engine. Those of skill in the art will readily recognize that this embodiment 100 could be adapted for use on either a diesel or gasoline engine with an in-line or V-type cylinder configuration.

FIG. 1 shows an injector hold down clamp or body 10 and an injector clamp bolt or fastener 40 inserted in the clamp 10. In a preferred embodiment, the clamp 10 preferably comprises a first and second injector hold down clamp arm 25 and 20 and a rear clamp seat 15. The clamp 10 arms 20 and 25 will engage the injector 200 (shown in FIGS. 2 and 3), while the injector clamp bolt or fastener 40 and the rear clamp seat will engage the cylinder head 300 (shown in FIG. 3). Each clamp arm 20 and 25 can further comprise a corresponding clamp hook 30 and 35. The clamp hooks 30 and 35 can cooperatively engage an injector retainer ring 905 (shown in FIG. 9) to assist in the assembly or pre-assembly of the injector 200 and hold down clamp assembly 100 (shown in FIG. 2) to the cylinder head 300 (shown in FIG. 3).

In the preferred embodiment, the injector hold down clamp 10 is cast metal that is quenched and tempered to Rc 45–55 standards, while the injector clamp bolt or fastener 40 is a class 12.9 phosphate coated metal. Those of skill in the art will readily recognize that other types of materials can readily be used so long as the injector clamp 10 and bolt 40 can secure the injector 200 to the cylinder head 300 and adequately withstand any forces encountered during operation of the engine.

Figure 2:
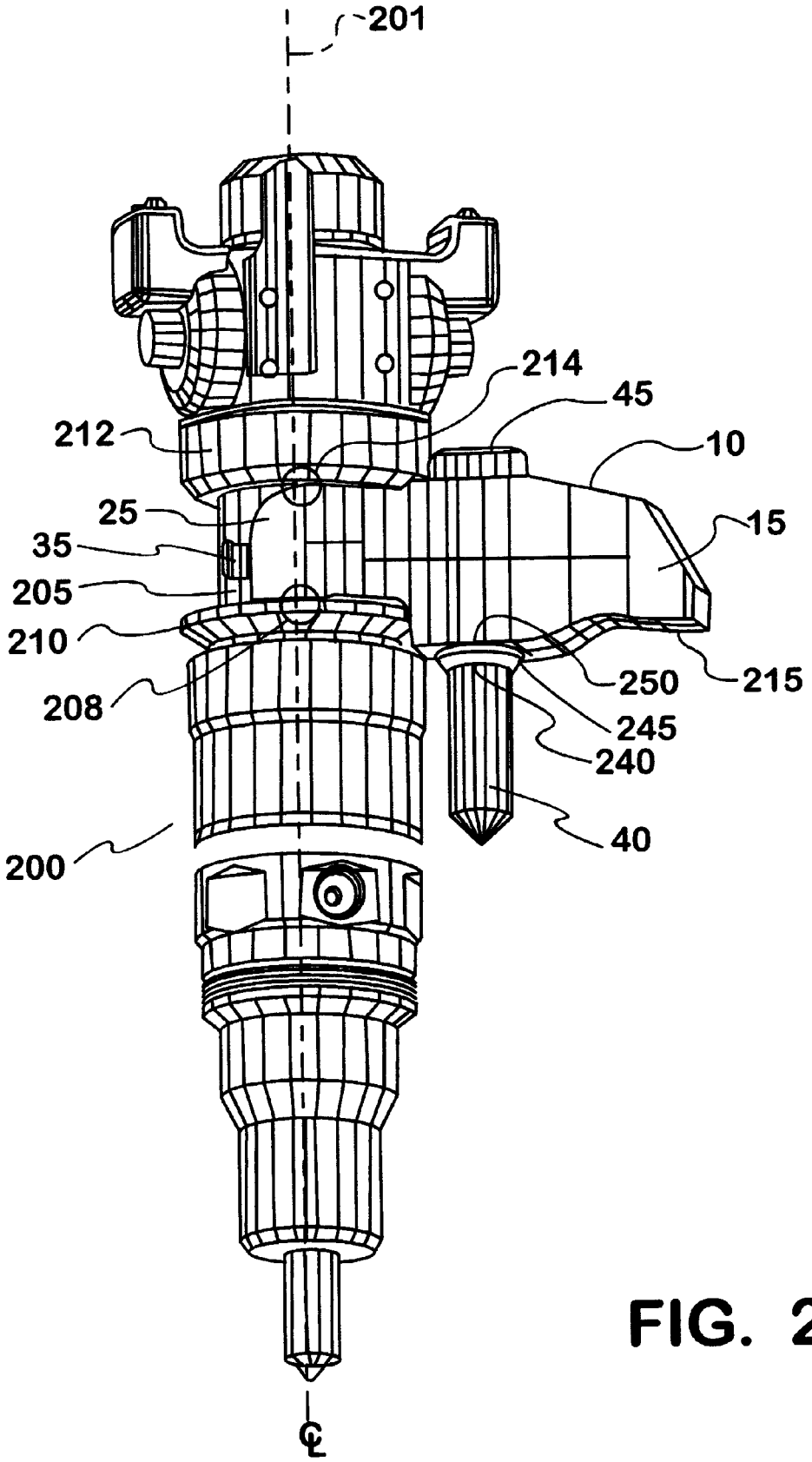
FIG. 2 shows a perspective view of the injector hold down clamp assembly of FIG. 1 cooperatively attached to a fuel injector according to the present invention.

FIG. 2 shows a perspective view of the injector hold down clamp assembly 100 cooperatively mounted to the fuel injector 200 according to the present invention. The injector hold down clamp assembly 100 engages an injector upper section 205 via the first and second clamp arms 25 and 20 (not shown). In a preferred embodiment, the first clamp arm 25 is cooperatively located adjacent to the injector upper section 205 and between a lower and upper injector shoulder 210 and 212. The second clamp arm 25 is similarly situated on the opposite side of the upper injector section 205 (not shown). There is also shown a clamp hook 35 on the first clamp arm 25 that along with a clamp hook 30 on the second arm 20 (shown in FIGS. 4 and 9) will accept an injector retainer ring 905 (shown in FIG. 9) such that the injector hold down clamp 10 can more easily be secured to the injector 200.

FIG. 2 also illustrates a retainer ring 245 attached to the fastener 40, a clamp retainer ring bore 250 and a fastener retainer ring section 240. The retainer ring 245 is preferably a partial toroid (also shown in FIGS. 6 and 8) that is attached or "snapped" onto the fastener retainer ring section 240 after the faster 40 has been inserted into the clamp body 10. The fastener retainer ring section 240 is further preferably located adjacent and below the clamp retainer ring bore 250 when the faster 40 is inserted in the clamp body 10 (also shown in FIG. 5). The cooperative interaction of the fastener 40, the retainer ring 240 and the clamp retainer ring bore will allow the fuel injector 200 to be removed from the cylinder head 300 without the need to pry the injector 200. There is also shown the bottom seating face 215 of the rear clamp seat 15 which will sit on a corresponding cylinder head boss 315 (shown in FIG. 3) when assembled to the cylinder head 300.

Figure 3:
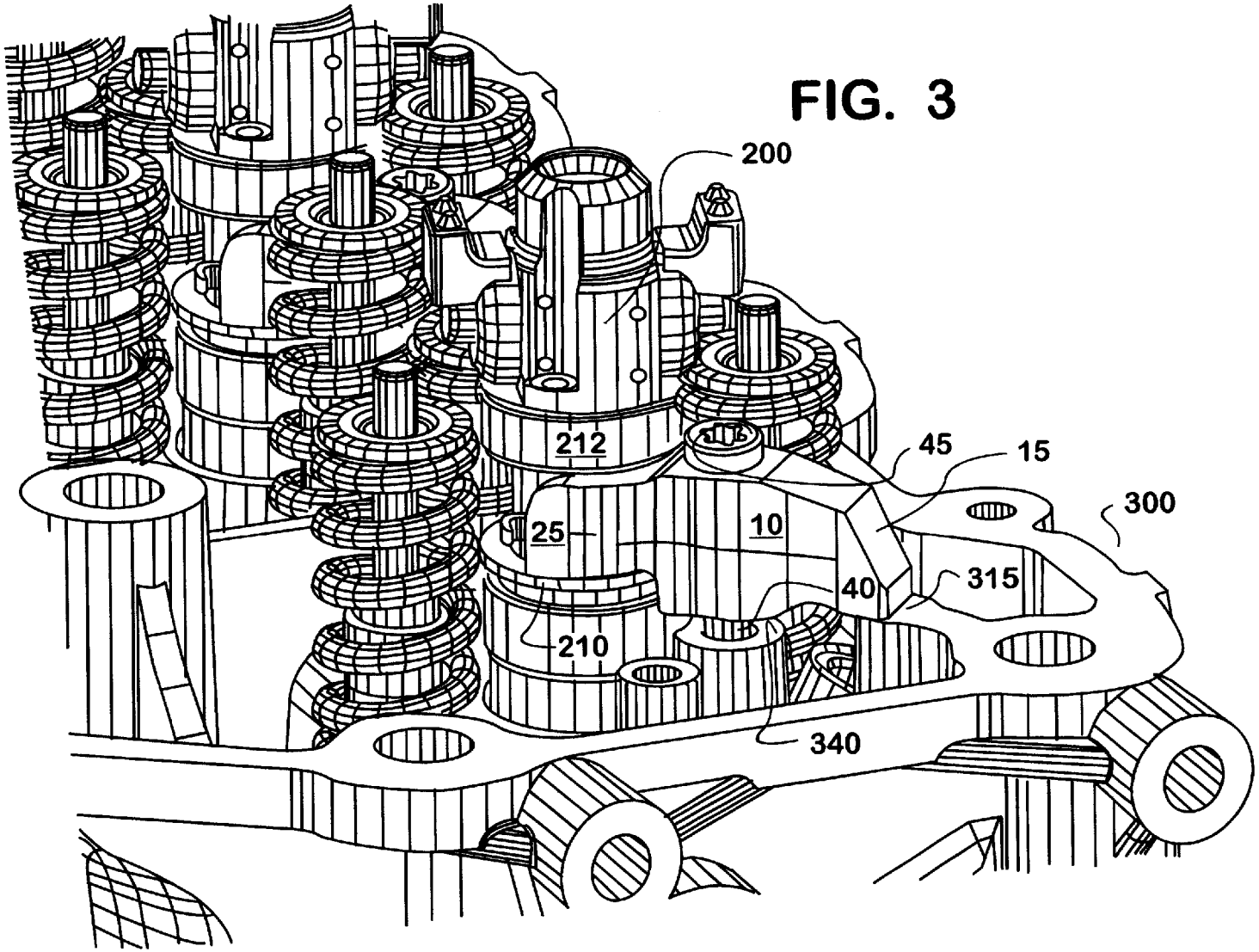
FIG. 3 shows a perspective view of the injector hold down clamp assembly and fuel injector of FIG. 2 cooperatively attached to a cylinder head according to the present invention.

FIG. 3 shows the injector hold down clamp assembly 100 and fuel injector 200 cooperatively installed or assembled to the cylinder head 300 according to the present invention. The injector hold down clamp assembly 100 allows the fuel injector 200 to be easily secured to and removed from the cylinder head 300.

To secure the fuel injector 200, the fuel injector 200 is inserted into the appropriate injector bore (not shown) and the hold down assembly 100 fastener 40 is bolted to a tapped cylinder head boss 340. During installation, as the fastener 40 is tightened down, the fastener head 45 will exert a downward force on the top 304 of the clamp 10. This downward force is translated to the fuel injector 200 via the clamp arms 25 and 20 which act on the fuel injector 200 via the lower injector shoulder 210 thereby exerting a downward compressive force to secure the injector 200 in the cylinder head 300. The clamp arms 25 and 20 a configured such that they physically contact the lower injector shoulder 210 at opposing points 208 (shown in FIG. 2) that are in-line and parallel to the injector centerline 201 (show in FIG. 2) thereby allowing for balanced and even application of the downward compressive force on the fuel injector 200. In the embodiment shown, the fuel injector 200 will reach its final installed or assembled position when the rear clamp seat 15 contacts a corresponding cylinder head boss 315 after certain downward travel by the clamp body 100 due to tightening of the fastener 40. The fuel injector 200 has now been installed using a preferred embodiment of the injector hold down clamp assembly 100 of the present invention.

Disassembly of the fuel injector 200 from the cylinder head 300 using the injector hold down clamp 100 is accomplished by simply unscrewing or untightening the fastener 40. As the fastener 40 is untightened and travels upward, the retainer ring 245 correspondingly travels upward as well since the retainer ring is attached to the fastener retainer ring section 240. The retainer ring 245 initially enters the clamp retainer ring bore 250 (also shown in FIG. 5) as it travels upward and does not move the clamp body 10. However, as the fastener 40 continues to be untightened or unscrewed and to travel upward, the upwardly moving retaining ring 245 contacts the top 550 of the clamp retaining ring bore 250.

At this point, the retaining ring 245 is trapped in the clamp retaining ring bore 250 and the fastener retainer ring section 240 and any further upward movement by the retaining ring 245 will force the clamp 10 and injector 200 to be disassembled simultaneously as a unit. The retaining ring 240 will exert an upward force on the top 550 of the clamp retaining ring bore 250 and thereby an upward force on the clamp body 10. The upward force is translated to the fuel injector 200 via the clamp arms 25 and 20 which act on the fuel injector 200 via the upper injector shoulder 212 thereby exerting a corresponding upward force to unseat or disassemble the injector 200 from the cylinder head 300. The clamp arms 25 and 20 are preferably configured in such a manner that they physically contact the upper injector shoulder 212 at opposing points 214 (shown in FIG. 2) that are in-line and parallel to the injector centerline 201 (show in FIG. 2) thereby allowing for balanced and even application of the upward force on the fuel injector 200.

Continued untightening of the fastener 40 will result in the upward movement of the fuel injector 200 until it is unseated or disassembled from the cylinder head 300. The fuel injector 200 has now been removed from the space limited cylinder head 300 using the injector hold down clamp assembly 100 without the need to pry the injector out of the cylinder head 300.

FIG. 4 shows a top view of the injector hold down clamp assembly shown and discussed in FIGS. 1–3. There is shown the first and second clamp arms 25 and 20 with corresponding clamp hooks 35 and 30 and the rear clamp seat 15. There is also shown the top 45 of the fastener 40 inserted in the clamp body 10.

FIG. 5 shows a side view of the injector hold down clamp assembly shown and discussed in FIGS. 1–3. FIG. 5 shows in greater details the configuration of the clamp body 10 that allows the movement of the fastener 40 to be translated to the fuel injector 200. The clamp body 10 has a clamp orifice, channel or bore 540 that runs vertically thru the clamp body 10 and allows insertion of the fastener 40 therein. The top 544 of the clamp orifice 540 is complimentarily configured to match the inclined configuration 744 (shown in FIG. 7) of the fastener 40. In the preferred embodiment, the top 544 of the clamp orifice 544 is inclined to match the corresponding face of the fastener top 45. In the preferred embodiment, the cooperative interaction between the fastener top 45 and the clamp orifice top 544 translate downward movement to the fuel injector 200 (as discussed with respect to FIG. 3) as the fastener 40 is tightened or secured to the cylinder head 300. In the preferred embodiment, a clamp retainer ring bore 250 is located at the bottom of the clamp orifice or channel 540. The clamp retainer ring bore 250 is preferably concentric and larger than the clamp orifice 540, i.e., like a counter bore. As already discussed in FIG. 3 the interaction between the retainer ring 245 and the top 550 of the clamp retaining ring bore 250 translate upward movement of the fastener 40 to the fuel injector 200 as the fastener 40 is untightened or unscrewed from the cylinder head 300.

FIG. 6 shows a bottom view of the injector hold down clamp assembly 100 shown in FIGS. 1–3. There is shown a bottom view of the first and second clamp arms 25 and 20 with corresponding clamp hooks 35 and 30 and the bottom seating face 215 of the rear clamp seat 15. FIG. 6 shows more clearly that the retaining ring 245 acts upon the top 550 of the clamp retaining ring bore 250 thereby forcing the clamp or clamp body 10 to move upward when the fastener 40 moves upward as previously discussed.

Figure 7:
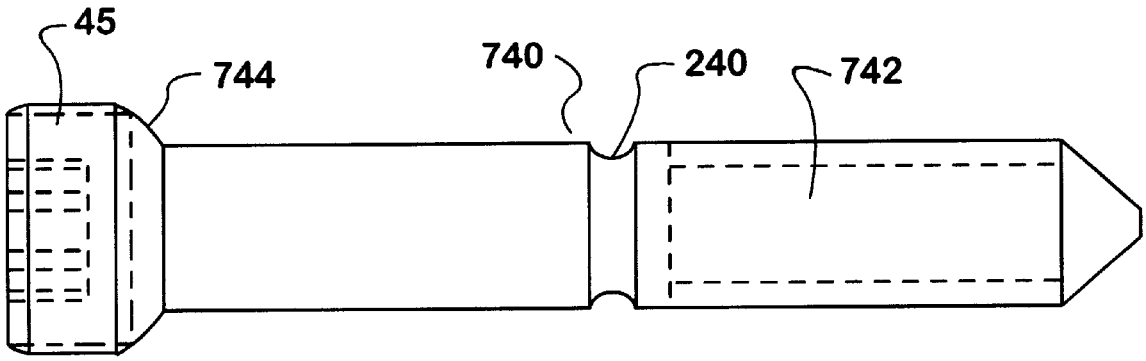
FIG. 7 shows a front view of an embodiment of a fastener for the injector hold down clamp shown in FIGS. 1–6.

FIG. 7 shows a front view of a preferred embodiment of a fastener for use in the injector hold down clamp assembly

100 of the present invention shown in FIGS. 1–6. There is shown the inclined configuration or face 744 that will match up with the top 544 of the clamp orifice 540. There is also shown the fastener retainer ring section 240 that will complimentarily accept the retainer ring 245 after the fastener 40 is inserted into the clamp orifice 540. In the preferred embodiment, the fastener retainer ring section 240 is preferably located in the midsection 740 of the fastener 40 and is located below and adjacent to the clamp retainer ring bore 250 (shown in FIG. 5). Those of skill in the art will readily recognize that the actual location of the fastener retainer ring section 240 on the fastener may vary depending a particular cylinder head, injector or engine design. The lower fastener section 742 will engage the cylinder head 300 to secure the clamp 10 to the cylinder head 300, preferably via a threaded connection between the lower fastener section 742 and the tapped cylinder head boss 340 (shown in FIG. 3).

Figure 8:
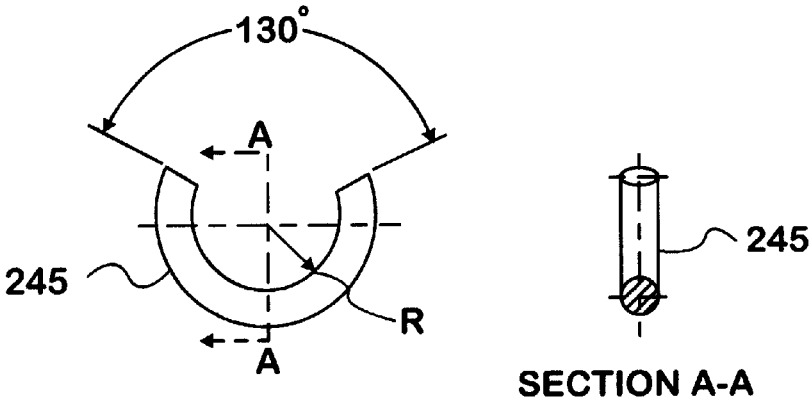
FIG. 8 shows a front and side view of an embodiment of a retaining ring for the injector hold down clamp shown in FIGS. 1–6.

FIG. 8 shows a front and side view of an embodiment of the retaining ring 245 that will be on the fastener retainer ring section 240 and engage the clamp retainer ring bore 250 in the injector hold down clamp assembly 100 shown in FIGS. 1–6. The retainer ring preferably has the shape of a partial toroid such that the retainer ring can be located or "snapped" onto the fastener retainer ring section 240 after the fastener 40 has been inserted into the clamp orifice 540. The retainer ring 245 preferably extends a range of 230 degrees or alternatively is missing a section that extends 130 degrees. However, the retainer ring 245 can also be a partial toroid that extends a range between 185 degrees to 240 degrees or alternatively that is missing a section that extends a range of between 175 degrees to 120 degrees. FIG. 8 further shows a cross section of the retainer ring 245 along the section line A—A. The cross-section shows that the retainer ring is preferably solid. Further, in the preferred embodiment, the retainer ring 245 is preferably 28-gauge music wire. Other type and size wire may be used. In that case, the faster retaining ring section and the clamp retaining ring bore 250 may have to be modified to accommodate the new retaining ring 245.

Figure 9:
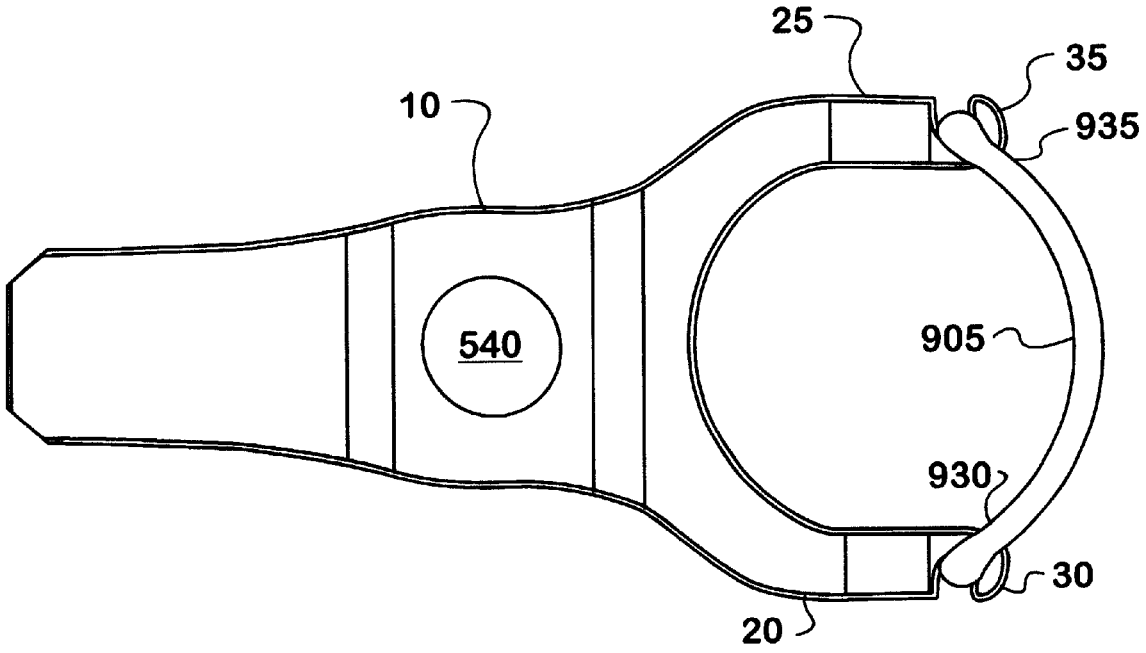
FIG. 9 shows a top view of an embodiment of an injector retaining ring for the injector hold down clamp according to the present invention.

FIG. 9 shows a top view of an embodiment of an injector retaining ring 905 attached to the injector hold down clamp 10 according to the present invention. The injector retaining ring 905 engages the first and second clamp hooks 35 and 30 at its opposing first and second ends 935 and 930. The injector retaining ring 905 in combination with the first and second clamp arms 35 and 30 will accept the fuel injector 200 and allow it to be more easily secured to and disassembled from the cylinder head 300. There is also shown the clamp orifice 540 that will accept a fastener 40.

The injector hold down clamp assembly 100 enables the fuel injector to be secured to the cylinder head 300 in an easier and more secure fashion. The injector hold down clamp assembly 100 further allows for the removal of the injector 200 from the cylinder head with prying the injector 200 from the cylinder head, as is commonly done in the prior art. The present invention will reduce and optimize engine assembly and disassembly costs and time.

The invention has been described and illustrated with respect to certain preferred embodiments by way of example only. Those skilled in that art will recognize that the preferred embodiments may be altered or amended without departing from the true spirit and scope of the invention. Therefore, the invention is not limited to the specific details, representative devices, and illustrated examples in this description. The present invention is limited only by the following claims and equivalents.

I claim:

1. An injector hold down clamp assembly for use with a fuel injector and a cylinder head in an internal combustion engine comprising:

a clamp having a fastener orifice;

a fastener operatively inserted in the clamp orifice; and a retaining ring operatively attached to the fastener;

whereby the retaining ring acts on the clamp during disassembly and thereby allows the fuel injector and injector hold down clamp assembly to be removed simultaneously.

2. The injector hold down clamp assembly of claim 1 wherein the clamp further comprises:

at least one clamp arm;

a clamp retainer ring bore; and a rear clamp seat.

3. The injector hold down clamp assembly of claim 1, wherein the retaining ring is attached to a fastener retainer ring section.

4. The injector hold down clamp assembly of claim 1, wherein the retaining ring is a partial toroid.

5. The injector hold down clamp assembly of claim 4, wherein the retaining ring extends 230 degrees.

6. An injector hold down clamp assembly for use with a cylinder head in an internal combustion engine comprising:

a clamp comprising a fastener channel and a retainer ring bore;

a fastener operatively inserted in the fastener channel and having a fastener ring section; and a retaining ring operatively attached to the fastener retainer ring section;

whereby the retaining ring acts on the retainer ring bore during disassembly and thereby allows the fuel injector and injector hold down clamp assembly to be removed simultaneously.

7. The injector hold down clamp assembly of claim 6, wherein the retaining ring is a partial ring.

8. The injector hold down clamp assembly of claim 7, wherein the retaining ring extends 230 degrees.

9. An injector hold down clamp assembly for use with a fuel injector and a cylinder head in an internal combustion engine comprising:

an injector clamp;

a clamp fastener cooperatively attached to the injector clamp; and a retaining ring cooperatively attached to the clamp fastener;

whereby the retaining ring acts on the injector clamp during disassembly and thereby allows the fuel injector and injector hold down clamp assembly to be removed simultaneously.

10. The injector hold down clamp of claim 9, wherein the clamp further comprises:

a fastener orifice;

a clamp retainer ring section;

a rear clamp seat; and a first and second a clamp arm.

11. The injector hold down clamp of claim 10, wherein the first and second clamp arms each have a clamp hook that together cooperatively engage an injector retaining wire.

12. The injector hold down clamp assembly of claim 9, wherein the retaining ring is a partial ring.

13. The injector hold down clamp assembly of claim 12, wherein the retaining ring extends 230 degrees.

* * * * *